US006213659B1

(12) United States Patent
Elgee

(10) Patent No.: US 6,213,659 B1
(45) Date of Patent: Apr. 10, 2001

(54) PRINT MEDIUM LOADING ERROR DETECTION FOR USE IN PRINTING DEVICES

(75) Inventor: Steven B. Elgee, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/404,918

(22) Filed: Sep. 24, 1999

(51) Int. Cl.[7] ..... B41J 13/26; B41J 13/30

(52) U.S. Cl. ..... 400/633; 400/633.2; 400/579; 400/624; 400/703; 400/709; 400/709.2; 271/171; 347/104

(58) Field of Search ..... 400/579, 624, 400/630, 631, 633, 633.1, 633.2, 703, 709, 709.2; 271/171, 223; 399/81, 389, 393; 347/101, 104, 105

(56) References Cited

U.S. PATENT DOCUMENTS 5,110,106 * 5/1992 Matsumura et al. ..... 271/171
5,826,156 * 10/1998 Natsume et al. ..... 399/389
5,923,942 * 7/1999 Nuggehalli ..... 399/389

FOREIGN PATENT DOCUMENTS 63-134431 * 6/1988 (JP) ..... 271/171
5-178469 * 7/1993 (JP) ..... 271/171
5-319585 * 12/1993 (JP) ..... 271/171
60-56741 * 5/2000 (JP) .

* cited by examiner

*Primary Examiner*—Daniel J. Colilla
(74) *Attorney, Agent, or Firm*—Erik A. Anderson

(57) ABSTRACT

Apparatuses and methods for detecting error in loading print media in a printing device are disclosed. An apparatus embodiment includes a width adjuster position sensor that determines a position of a print medium width adjuster, a width sensor that measures a width of a print medium, and a computing device that compares the width adjuster position with the print medium width, and verifies that the width adjuster is properly positioned for the print medium width. Another embodiment includes a length adjuster position sensor that determines a position of a print medium length adjuster, a length sensor that measures a length of the print medium, and a computing device that compares the length adjuster position with the print medium length, and verifies that the length adjuster is properly positioned for the print medium length. A method embodiment includes determining a position of a width adjuster, measuring a width of a print medium, comparing the width adjuster position with the print medium width, and prompting a user to properly position the width adjuster when the width adjuster is improperly positioned for the print medium width. Another method embodiment includes determining a position of a length adjuster, measuring a length of the print medium, comparing the length adjuster position with the print medium length, and prompting a user to properly position the length adjuster when the length adjuster is improperly positioned for the print medium length. Further characteristics and features of the apparatuses and methods are disclosed herein, as are exemplary alternative embodiments.

14 Claims, 6 Drawing Sheets

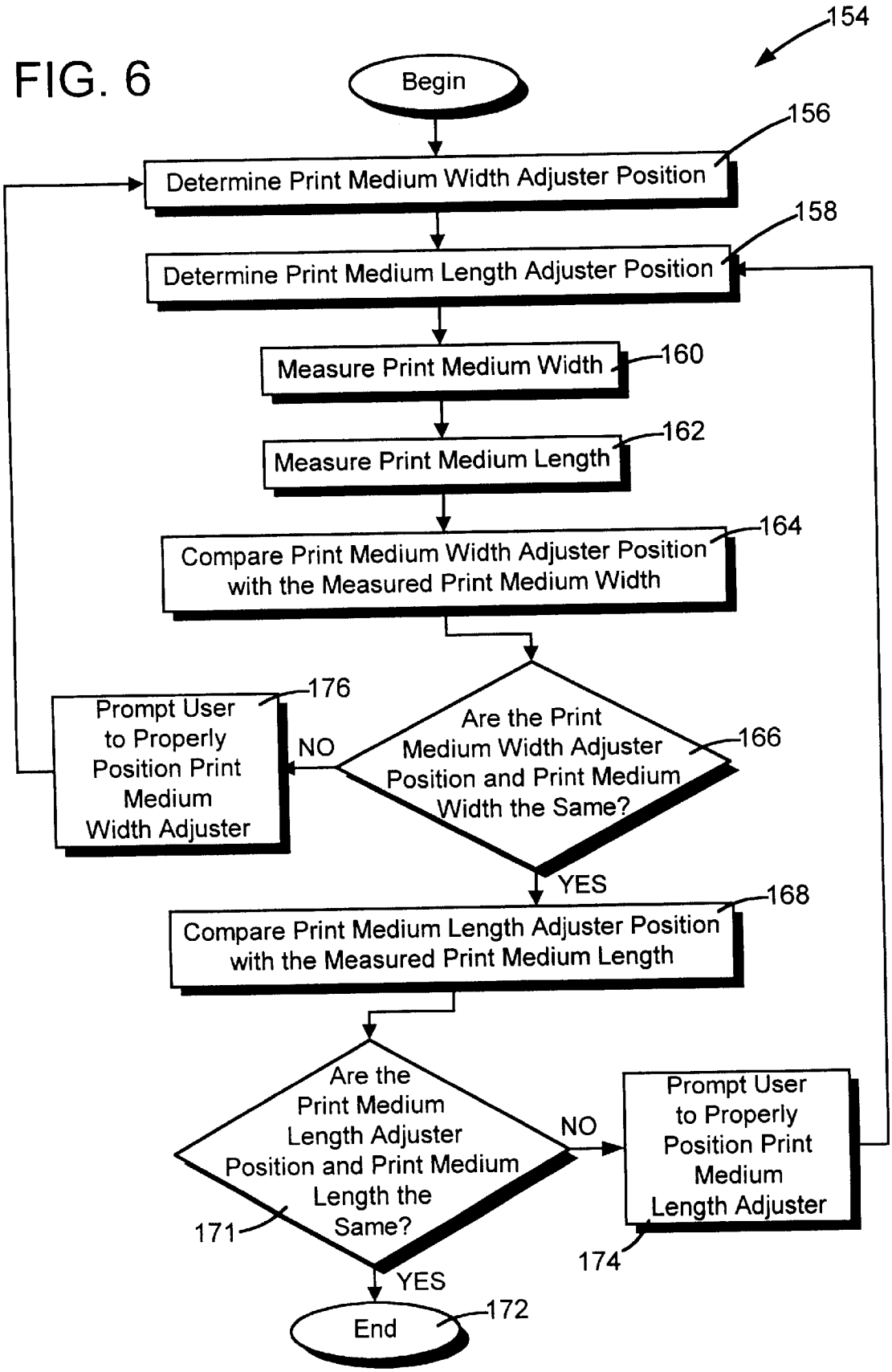
FIG. 6
154
Begin
156
Determine Print Medium Width Adjuster Position
158
Determine Print Medium Length Adjuster Position
Measure Print Medium Width
160
Measure Print Medium Length
162
Compare Print Medium Width Adjuster Position with the Measured Print Medium Width
164
Are the Print Medium Width Adjuster Position and Print Medium Width the Same?
166
NO
Prompt User to Properly Position Print Medium Width Adjuster
176
YES
Compare Print Medium Length Adjuster Position with the Measured Print Medium Length
168
Are the Print Medium Length Adjuster Position and Print Medium Length the Same?
171
NO
Prompt User to Properly Position Print Medium Length Adjuster
174
YES
End
172

PRINT MEDIUM LOADING ERROR DETECTION FOR USE IN PRINTING DEVICES

BACKGROUND AND SUMMARY

The present invention relates to printing devices. More particularly, the present invention relates to an apparatus and method for detecting error in loading a print medium in a printing device.

Printing devices, such as inkjet printers and laser printers, use printing composition (e.g., ink or toner) to print text, graphics, images, etc. onto a print medium. Inkjet printers may use print cartridges, also known as "pens", which shoot drops of printing composition, referred to generally herein as "ink", onto a print medium such as paper, transparencies or cloth. Each pen has a printhead that includes a plurality of nozzles. Each nozzle has an orifice through which the drops are fired. To print an image, the printhead is propelled back and forth across the page by, for example, a carriage while shooting drops of ink in a desired pattern as the printhead moves. The particular ink ejection mechanism within the printhead may take on a variety of different forms known to those skilled in the art, such as thermal printhead technology.

In a current thermal system, a barrier layer containing ink channels and vaporization chambers is located between an orifice plate and a substrate layer. This substrate layer typically contains linear arrays of heating elements, such as resistors, which are energized to heat ink within the vaporization chambers. Upon heating, the ink in the vaporization chamber turns into a gaseous state and forces or ejects an ink drop from an orifice associated with the energized resistor. By selectively energizing the resistors as the printhead moves across the print medium, ink is expelled in a pattern on to the print medium to form a desired image (e.g. picture, chart and/or text).

Printing devices typically include one or more print media input devices, such as input trays for sheets of print media or input racks for rolls of print media. These input trays and input racks usually include means to adjust for the particular width and/or length of the print media to help assure proper registration of the print media in the input tray or on the input rack. Proper registration in turn helps ensure that print media is fed into the print zone of a printing device in the correct alignment so that the printed image is properly oriented on the print media which helps achieve high-quality printed output by the printing device.

The means to adjust for the particular width and/or length of the print medium includes a print medium width adjuster and/or a print medium length adjuster. The positions of such print medium width adjusters and a print medium length adjusters may be varied through a range of predetermined distances, either manually or mechanically, so that such adjusters abut against the print medium.

If a user of a printing device improperly positions either the print medium width adjuster or the print medium length adjuster, then the print medium may be incorrectly fed into the print zone of the printing device such that the printed image is improperly oriented on the print medium, producing less than optimal output print quality. In some cases, the printed output may be partially or completely illegible. Improper positioning of either the print medium width adjuster or print medium length adjuster may also lead to jamming of the printing device during transport of the print medium to the print zone which requires user intervention to clear the jam and decreases printing device throughput, both of which are undesirable. Improper positioning of either the print medium width adjuster or print medium length adjuster may further lead to wasted print medium caused by such poor printing device output print quality and jamming, both of which can be expensive.

Alleviation of these problems would be a welcome improvement, thereby helping to maintain optimal printing device output print quality, prevent print medium jamming, optimize printing device throughput, minimize necessary user intervention, and prevent waste of print media. Accordingly, the present invention is directed to solving printing device problems caused by improper positioning of either the print medium width adjuster or print medium length adjuster. The present invention accomplishes this objective by providing an apparatus and method for detecting error in loading a print medium in a printing device.

An embodiment of a method in accordance with the present invention for use in a printing device includes determining a position of a print medium width adjuster and measuring a width of a print medium. The method additionally includes comparing the print medium width adjuster position with the determined print media width and prompting a user of the printing device to properly position the print medium width adjuster in instances where the print medium width adjuster is improperly positioned for the determined print media width.

The above-described embodiment of a method in accordance with the present invention may be modified and include the following, as described below. The method may additionally include determining a position of a print medium length adjuster and measuring a length of the print medium. In such cases, the method additionally includes comparing the print medium length adjuster position with the determined print medium length and prompting a user of the printing device to properly position the print medium length adjuster in instances where the print media length adjuster is improperly positioned for the determined print medium length.

An alternative embodiment of a method in accordance with the present invention includes determining a position of a print medium length adjuster and measuring a length of a print medium. The method additionally includes comparing the print medium length adjuster position with the determined print medium length and prompting a user of the printing device to properly position the print medium length adjuster in instances where the print medium length adjuster is improperly positioned for the determined print medium length.

An embodiment of an apparatus in accordance with the present invention for use in a printing device includes a print medium width adjuster sensor configured to determine a position of a print medium width adjuster. The apparatus also includes a width sensor configured to measure a width of a print medium. The apparatus further includes a computing device configured both to compare the print medium width adjuster position determined by the print medium width adjuster position sensor with the print medium width measured by the width sensor, and to verify that the print medium width adjuster is properly positioned for the determined print media width.

The above-described embodiment of an apparatus in accordance with the present invention may be modified and include the following characteristics, as described below. The apparatus may additionally include a print medium length adjuster position sensor configured to determine a position of a print medium length adjuster and a length sensor configured to measure a length of the print medium. In such cases, the computing device is additionally configured both to compare the print medium length adjuster position determined by the print medium length adjuster position sensor with the print medium length measured by the length sensor, and to verify that the print medium length adjuster is properly positioned for the determined print medium length.

The length sensor may include a print medium axis position quadrature encoder. The length sensor may additionally or alternatively include a flag configured to be actuated by the print medium.

The width sensor may include a printing device carriage position quadrature encoder.

An alternative embodiment of an apparatus in accordance with the present invention for use in a printing device includes a print medium length adjuster position sensor configured to determine a position of a print medium length adjuster. The apparatus also includes a length sensor configured to measure a length of a print medium. The apparatus further includes a computing device configured both to compare the print medium length adjuster position determined by the print medium length adjuster position sensor with the print medium length measured by the length sensor, and to verify that the print medium length adjuster is properly positioned for the determined print medium length.

The above-described alternative embodiment of an apparatus in accordance with the present invention may be modified to include the following characteristics, as described below. The length sensor may include a print medium axis position quadrature encoder. The length sensor may additionally or alternatively include a flag configured to be actuated by the print medium.

Another alternative embodiment of an apparatus in accordance with the present invention for use in a printing device includes structure for determining a position of a print medium width adjuster and structure for measuring a width of a print medium. The apparatus additionally includes structure for comparing the print medium width adjuster position with the determined print media width and structure for prompting a user of the printing device to properly position the print medium width adjuster when the print medium width adjuster position differs from the determined print medium width.

The above-described additional alternative embodiment of an apparatus in accordance with the present invention may be modified to include the following characteristics, as described below. The apparatus may further include structure for determining a position of a print medium length adjuster and structure for measuring a length of the print medium. In such cases, the apparatus further includes structure for prompting a user of the printing device to properly position the print medium length adjuster when the print medium length adjuster position differs from the determined print medium length.

A still further alternative embodiment of apparatus in accordance with the present invention for use in a printing device includes structure for determining a position of a print medium length adjuster and structure for measuring a length of a print medium. The apparatus additionally includes structure for comparing the print medium length adjuster position with the determined print medium length and structure for prompting a user of the printing device to properly position the print medium length adjuster when the print medium length adjuster position differs from the determined print medium length.

Other objects, advantages, and novel features of the present invention will become apparent from the following detailed description of the invention when considered in conjunction with the accompanying drawings.

BRIEF DESCRIPTION OF THE DRAWINGS

FIG. 6 is a flow chart of an embodiment of a method in accordance with the present invention.

DETAILED DESCRIPTION OF THE DRAWINGS

Figure 1:
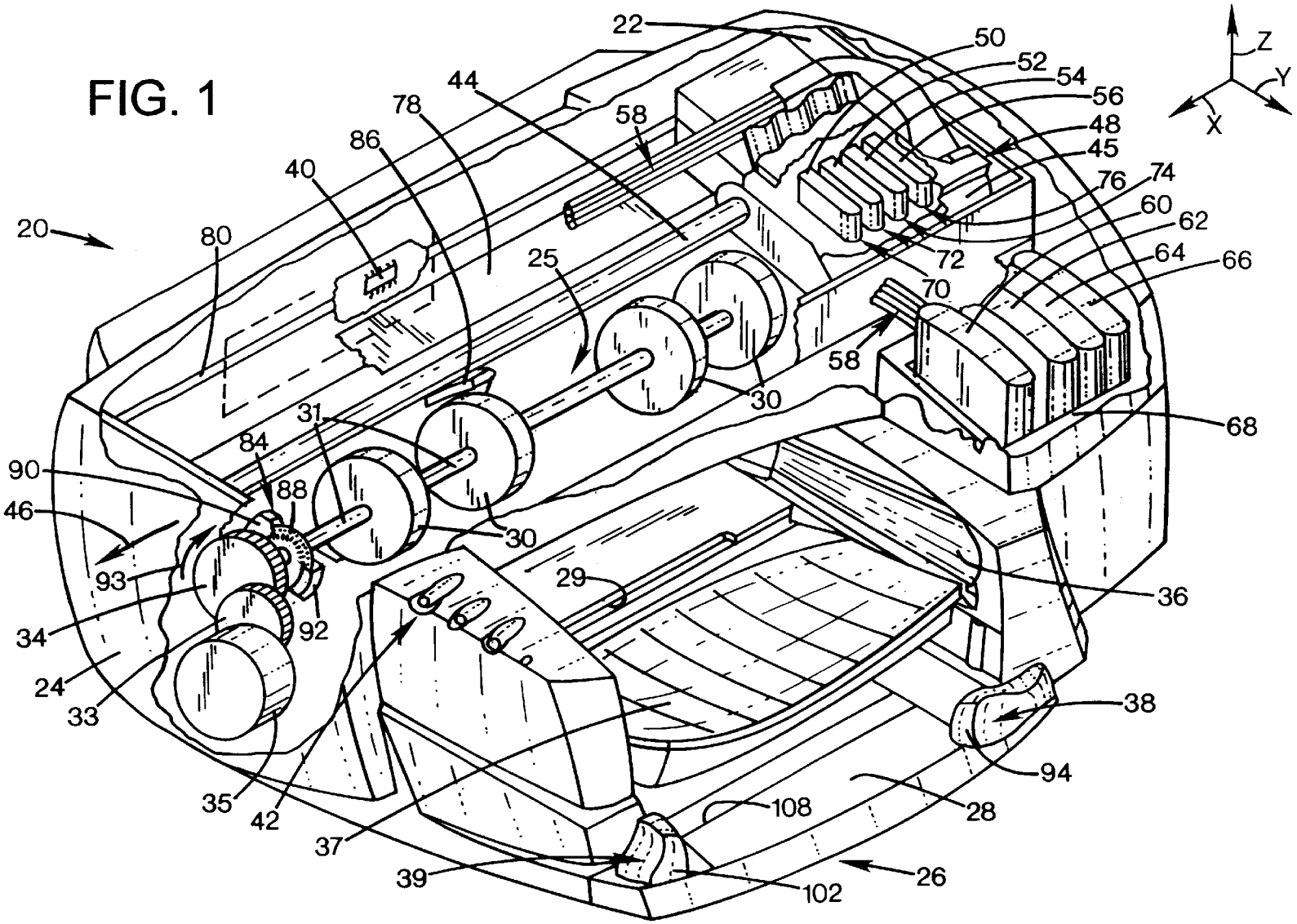
FIG. 1 is a perspective view of a printing device that includes an embodiment of the present invention.

FIG. 1 illustrates an embodiment of an inkjet printing device 20, here shown as an a "off-axis" inkjet printer, constructed in accordance with the present invention, which may be used for printing business reports, correspondence, desktop publishing, and the like, in an industrial, office, home or other environment. A variety of inkjet printing devices are commercially available. For instance, some of the printing devices that may embody the present invention include plotters, portable printing units, copiers, cameras, video printers, and facsimile machines, to name a few, as well as various combination devices, such as combination facsimiles and printers. In addition, the present invention may be used in other types of printing devices such as "on-axis" inkjet printers, dot matrix printers, and laser jet printers. For convenience, the concepts of the present invention are illustrated in the environment of inkjet printer 20.

While printing device components may vary from model to model, a typical inkjet printer 20 includes a frame or chassis 22 surrounded by a housing, casing or enclosure 24, typically made of a plastic material. Sheets of print media are fed through a printzone 25 by a print media handling system 26. The print media may be any type of suitable material, such as paper, card-stock, transparencies, photographic paper, fabric, metalized media, etc. Print media handling system 26 includes an input tray 28 for storing sheets of print media for printing. A series of conventional print media drive rollers 30 rotate about a shaft 31 which is driven by a motor 35 through a series of drive gears 33 and 34. Gears 33 and 34 are rotateably coupled to shaft 31 to rotate shaft 31 in a direction generally indicated by arrow 93. Drive rollers 30 are used to move print medium from input tray 28, through printzone 25 and, after printing, onto a pair of extendable output drying wing members 36, shown in a retracted or rest position in FIG.1. Wings 36 momentarily hold a newly printed sheet of print media above any previously printed sheets still drying in an output tray 37. Print media handling system 26 also includes means for accommodating different sizes of print media, including letter, legal, A-4, B, envelopes, etc. This means includes a print medium length adjuster 38 and a print medium width adjuster 39. As discussed below in connection with FIG. 2, print medium length adjuster 38 and print medium width adjuster 39 are manually repositionable against the sides of different sizes of print medium, and thereby accommodate for these different sizes. An envelope feed port 29 may be used in lieu of repositioning print medium length adjuster 38 and print medium width adjuster 39 to accommodate for the smaller size of such envelopes. Although not shown, it is to be understood that print media handling system 26 may also include other items such as one or more additional input trays. Additionally, print media handling system 26 and printing device 20 may be configured to support specific print tasks such as duplex printing (i.e., printing on both sides of the sheet of print media) and banner printing.

Printing device 20 also has a computing device 40, illustrated as a microprocessor or controller, that receives instructions from a host device, typically a computer, such as a personal computer (not shown). Many of the functions of computing device 40 may be performed by a host computer, including any printing device drivers resident on the host computer, by electronics in the printing device, or by interactions between the host computer and the electronics. As used herein, the term "computing device 40" encompass these functions, whether performed by a host computer, printing device 20, an intermediary device between the host computer and printing device 20, or by combined interaction of such elements. Computing device 40 may also operate in response to user inputs provided through a keypad 42 located on the exterior of casing 24. A monitor (not shown) coupled to the computer host may be used to display visual information to a user of printing device 20, such as the printer status or a particular program being run on the host computer. Personal computers, input devices, such as a keyboard and/or a mouse device, and monitors are all known to those skilled the art.

A carriage guide rod 44 is supported by chassis 22 to slideably support an off-axis inkjet carriage 45 for travel back and forth across printzone 25 along a scanning axis generally designated by arrow 46 in FIG. 1. As can be seen in FIG. 1, scanning axis 46 is substantially parallel to be X-axis of the XYZ coordinate system shown in FIG. 1. It should be noted that the use of the words substantially in this document is used to account for things such as engineering and manufacturing tolerances, as well as variations not affecting performance of the present invention. Carriage 45 is also propelled along guide rod 44 into a servicing region, generally indicated by arrow 48, located within the interior of housing 24 of printing device 20. A conventional carriage drive gear and motor assembly (both of which are not shown in FIG. 1) may be coupled to drive an endless loop, which may be secured in a conventional manner to carriage 45, with the motor operating in response to control signals received from a computing device 40 to incrementally advanced carriage 45 along guide rod 44 in response to movement of the motor.

In printzone 25, a sheet of print medium receives ink from an inkjet cartridge, such as black ink cartridge 50 and three monochrome color ink cartridges 52, 54, and 56. Cartridges 50, 52, 54, and 56 are also called "pens" by those skill the art. Pens 50, 52, 54, and 56 each include small reservoirs for storing a supply of printing composition, referred to generally herein as "ink" in what is known as an "off-axis" ink delivery system, which is in contrast to a replaceable ink cartridge system where each pen has a reservoir that carries the entire ink supply as the printhead reciprocates over printzone 25 along carriage scan axis 46. The replaceable ink cartridge system may be considered an "on-axis" system, whereas systems which store the main ink supply at a stationary location remote from the printzone scanning axis are called "off-axis" systems. It should be noted that the present invention is operable in both off-axis and on-axis systems.

In the illustrated off-axis printing device 20, ink of each color from each printhead is delivered via a conduit or tubing system 58 from a group of main ink reservoirs 60, 62, 64, and 66 to the on-board reservoirs of respective pens 50, 52, 54, and 56. Ink reservoirs 60, 62, 64, and 66 are replaceable ink supplies stored in a receptacle 68 supported by printer chassis 22. Each of pens 50, 52, 54, and 56 has a respective printhead, as generally indicated by arrows 70, 72, 74, and 76, which selectively ejects ink to form an image on a print medium in printzone 25.

Printheads 70,72, 74, and 76 each have an orifice plate with a plurality of nozzles formed therethrough in a manner well-known to those skill the art. The illustrated printheads 70,72, 74, and 76 are thermal inkjet printheads, although other types of printheads may be used, such as piezoelectric printheads. Thermal printheads 70,72, 74, and 76 typically include a plurality of resistors which are associated with the nozzles. Upon energizing a selected resistor, a bubble of gas is formed which ejects a droplet of ink from the nozzle onto the print medium in printzone 25 under the nozzle. The printhead resistors are selectively energized in response to firing command control signals delivered by a multi-conductor strip 78 (a portion of which is shown in FIG. 1) from computing device 40 to printhead carriage 45.

An optical quadrature encoder strip 80 extends along the length of printzone 25 and over the area of service station region 48 to provide carriage 45 positional feedback information to computing device 40, with a carriage position quadrature encoder reader 82 (see FIG. 4) being mounted on a back surface of printhead carriage 45 to read positional information provided by optical quadrature encoder strip 80. Together, optical quadrature 30 encoder strip 80 and carriage position quadrature encoder reader 82 constitute a printing device carriage position quadrature encoder. Printing device 20 uses optical quadrature encoder strip 80 and the carriage position quadrature encoder reader 82 to trigger the firing of printheads 70,72, 74, and 76, to provide feedback for position and velocity of carriage 45, and to measure the width of a print medium, as discussed more fully below in connection with FIG. 4.

Optical encoder strip 80 may be made from things such as photo imaged MYLAR brand film, and works with a light source and a light detector (both of which are not shown) of carriage position quadrature encoder reader 82. The light source directs light through strip 80 which is received by the light detector and converted into an electrical signal which is used by computing device 40 of printing device 20 to control firing of printheads 70, 72, 74, and 76, to control carriage 45 position and velocity, and to measure the width of a sheet of print medium, as discussed more fully below in connection with FIG. 4. Markings or indicia on encoder strip 80 periodically block this light from the light detector of carriage position quadrature encoder reader 82 in a predetermined manner which results in a corresponding change in the electrical signal from the detector of carriage position quadrature encoder reader 82 which is processed by computing device 40.

A print medium axis position quadrature encoder 84 is also shown in FIG. 1. Print medium axis position quadrature encoder 84 provides positional feedback information to computing device 40 regarding the position of print media drive rollers 30 and also provides data, in combination with flag 86, to computing device 40 so that the length of a print medium can be measured, as discussed below in connection with FIG. 3. Printing device 20 uses print medium axis position quadrature encoder 84 to help accurately position print medium in printzone 25, to control printing by one or more of printheads 70, 72, 74, and 76, and to measure the length of print medium, as discussed more fully below in connection with FIG. 3. Print medium axis position quadrature encoder 84 includes a rotary encoder 88 and a pair of rotary encoder readers 90 and 92. Rotary encoder 88 is coupled to shaft 31 to rotate therewith in the direction generally indicated by arrow 93.

Rotary encoder 88 may be made from things such as photo imaged MYLAR brand film, and works with a light source and a light detector (both of which are not shown) of each of rotary encoder readers 90 and 92. These light sources direct light through rotary encoder 88 which is received by the light detectors and converted into an electrical signal which is used by computing device 40 of printing device 20 to help accurately position print medium in printzone 25, to control firing of printheads 70, 72, 74, and 76, and to measure the length of print medium, as discussed more fully below in connection with FIG. 3. Markings or indicia on rotary encoder 88 periodically block this light from the light detectors of rotary encoder readers 90 and 92 in a predetermined manner which results in a corresponding change in the electrical signal from the detectors of rotary encoder readers 90 and 92 which is processed by computing device 40.

Figure 2:
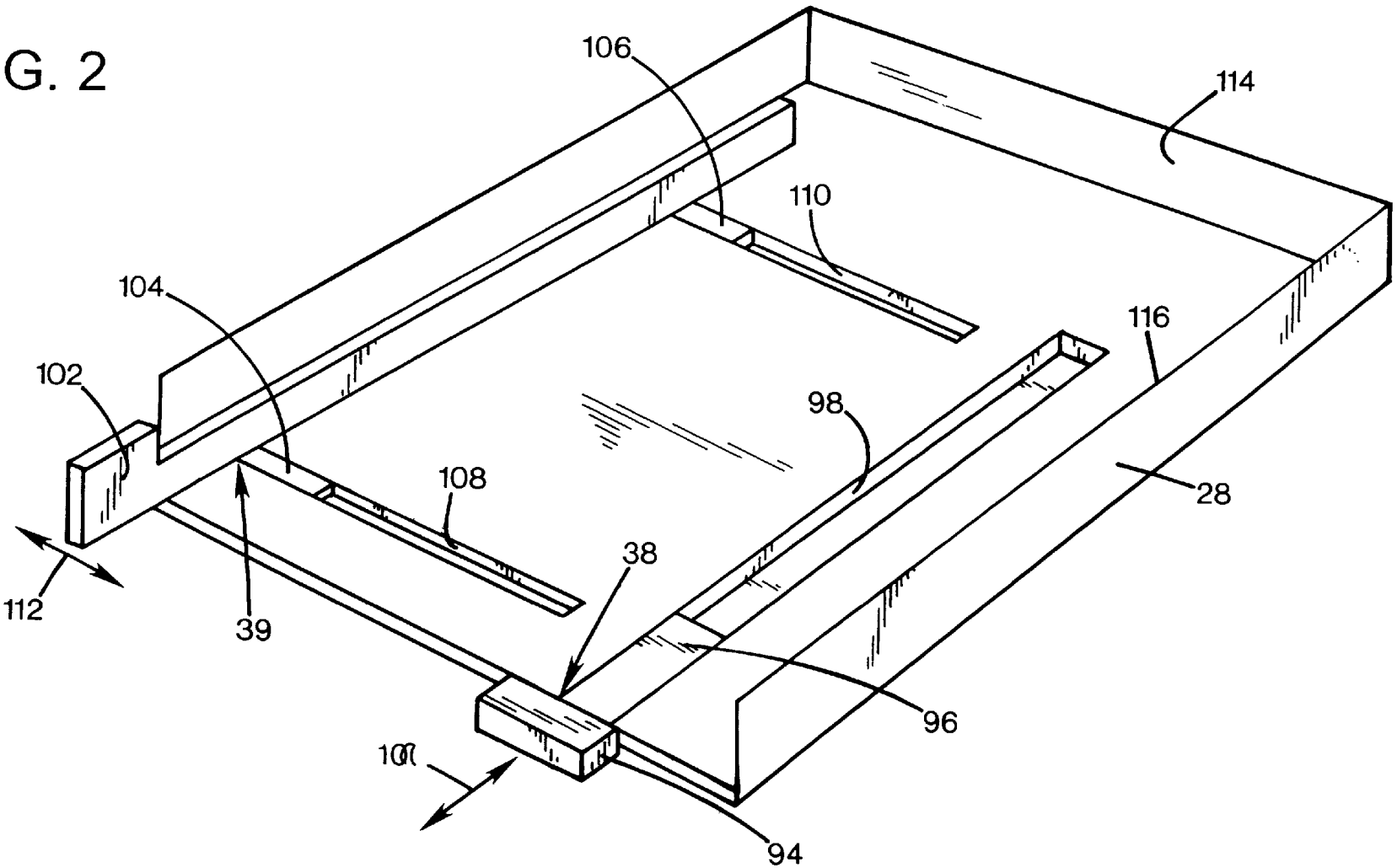
FIG. 2 is a perspective view of an input tray having a manually repositionable print medium width adjuster and a manually repositionable print medium length adjuster.

A perspective view of input tray 28 with manually repositionable print medium length adjuster 38 and a manually repositionable print medium width adjuster 39 is shown in FIG. 2. As can be seen in FIG. 2, print medium length adjuster 38 includes a handle portion 94 for manual grasping that is coupled to a base portion 96. Input tray 28 in turn is formed to include a track 98 of a predetermined length that is sized to slideably receive base portion 96 of print medium length adjuster 38. In this way, print medium length adjuster 38 is manually repositionable along the length of track 98 in the directions indicated by double-headed arrow 100 so that input tray 28 can accommodate for a variety of different lengths of print medium by placing handle portion 94 against a side of the print medium.

As can also be seen in FIG. 2, print medium width adjuster 39 includes a handle portion 102 that is coupled to base portions 104 and 106. Input tray 28 in turn is formed to include tracks 108 and 110 each of a predetermined length that are sized to slideably receive base portions 104 and 106 of print medium width adjuster 39. In this way, print medium width adjuster 39 is manually repositionable along the lengths of tracks 108 and 110 in the directions indicated by double-headed arrow 112 so that input tray 28 can accommodate for a variety of different widths of print medium by placing handle portion 102 against a side of the print medium.

In operation of printing device 20, print medium length adjuster 38 and print medium width adjuster 39 should be positioned against the sides of a print medium in input tray 28 to help assure proper registration of the print medium against respective walls 114 and 116 of input tray 28. Such registration in turn helps assure proper transport by print media handling system 26 from input tray 28 to printzone 25.

Figure 3:
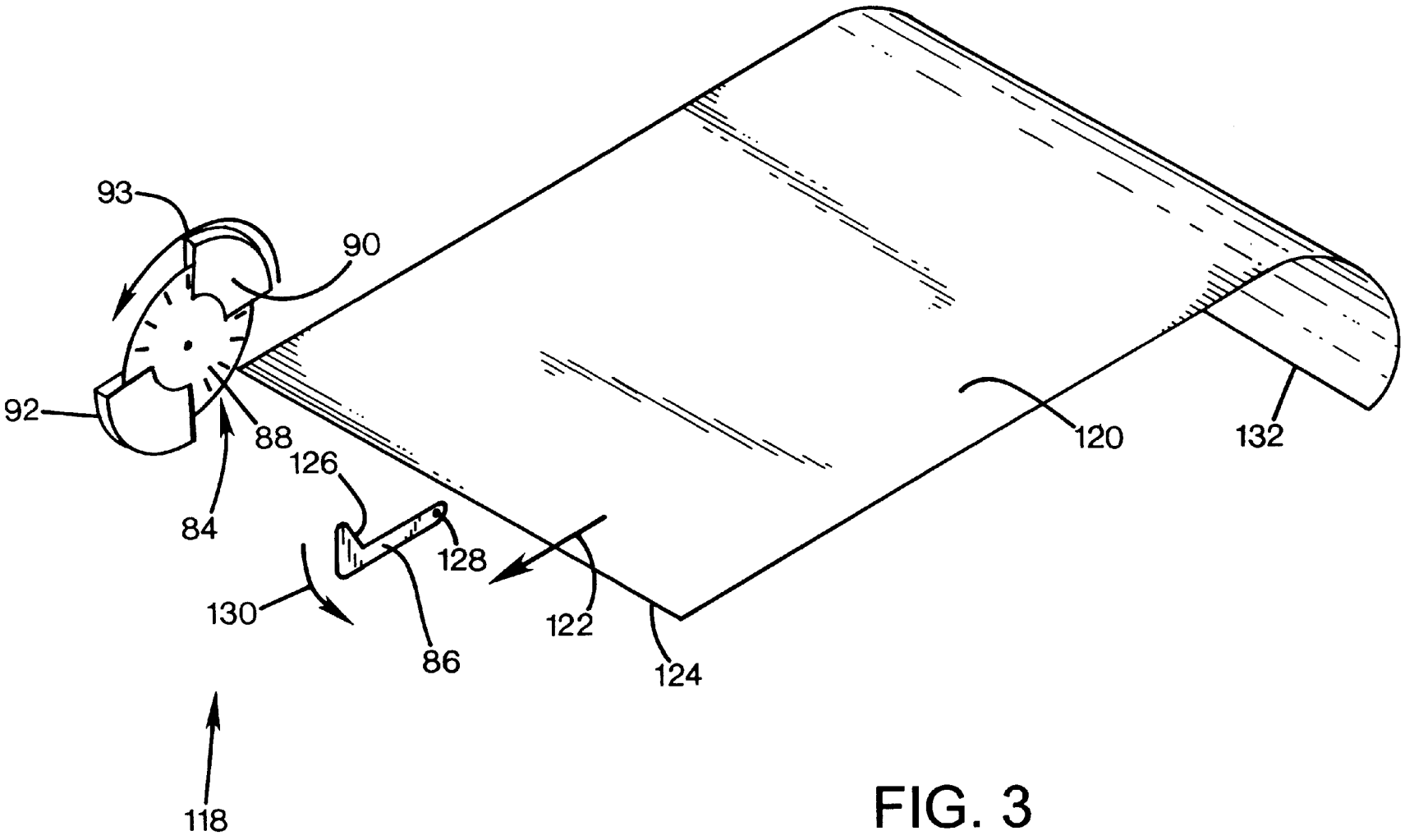
FIG. 3 is a perspective view of a print medium length sensor in accordance with the present invention configured to measure a length of a print medium.

A perspective view of a print medium length sensor 118 constructed in accordance with the present invention is shown in FIG. 3. Print medium length sensor 118 is configured to measure a length of different sizes of print medium transported by print medium handling system 26 from input tray 28 to printzone 25, such as the length of print medium 120. As can be seen in FIG. 3, print medium length sensor 118 includes print medium axis position quadrature encoder 84 and flag 86 which is schematically illustrated in FIG. 3.

In operation, print medium 120 is transported from input tray 28 to printzone 25 by print media handling system 26 in a direction generally indicated by arrow 122. Prior to entering printzone 25, side 124 of print medium 120 contacts angled edge 126 of flag 86 which actuates flag 86 about pivot 128 in the direction shown by arrow 130. Actuation of flag 86 about pivot 128 in the direction of arrow 130 signals computing device 40 to begin tracking rotation of rotary encoder 88 in the direction generally indicated by arrow 93 via rotary encoder readers 90 and 92. Flag 86 remains in this position until edge 132 of print medium 120 clears angled edge 126, at which point flag 86 returns to its original position which signals computing device 40 to cease tracking rotation of rotary encoder 88 via rotary encoder readers 90 and 92. Computing device 40 can then calculate the length of print medium 120 by using the length of the diameter of drive rollers 30 and the number of turns of rotary encoder 88 between edges 124 and 132 via the formula:

$$\text{Print Medium Length}=(\text{Number of Rotations})\times C_{drive\ rollers\ 30}=(\text{Number of Rotations})\times\pi\times d_{drive\ rollers\ 30},$$

where (Number of Rotations) is the number of rotations of rotary encoder 88, (C) is the circumference of drive rollers 30, and (d) is the diameter of drive rollers 30. For example, if d=1.0000 inches, Number of Rotations=3.5014, then:

$$\text{Print Medium Length}=(3.5014)\times(\pi)\times(1.000)=11\text{ inches.}$$

Figure 4:
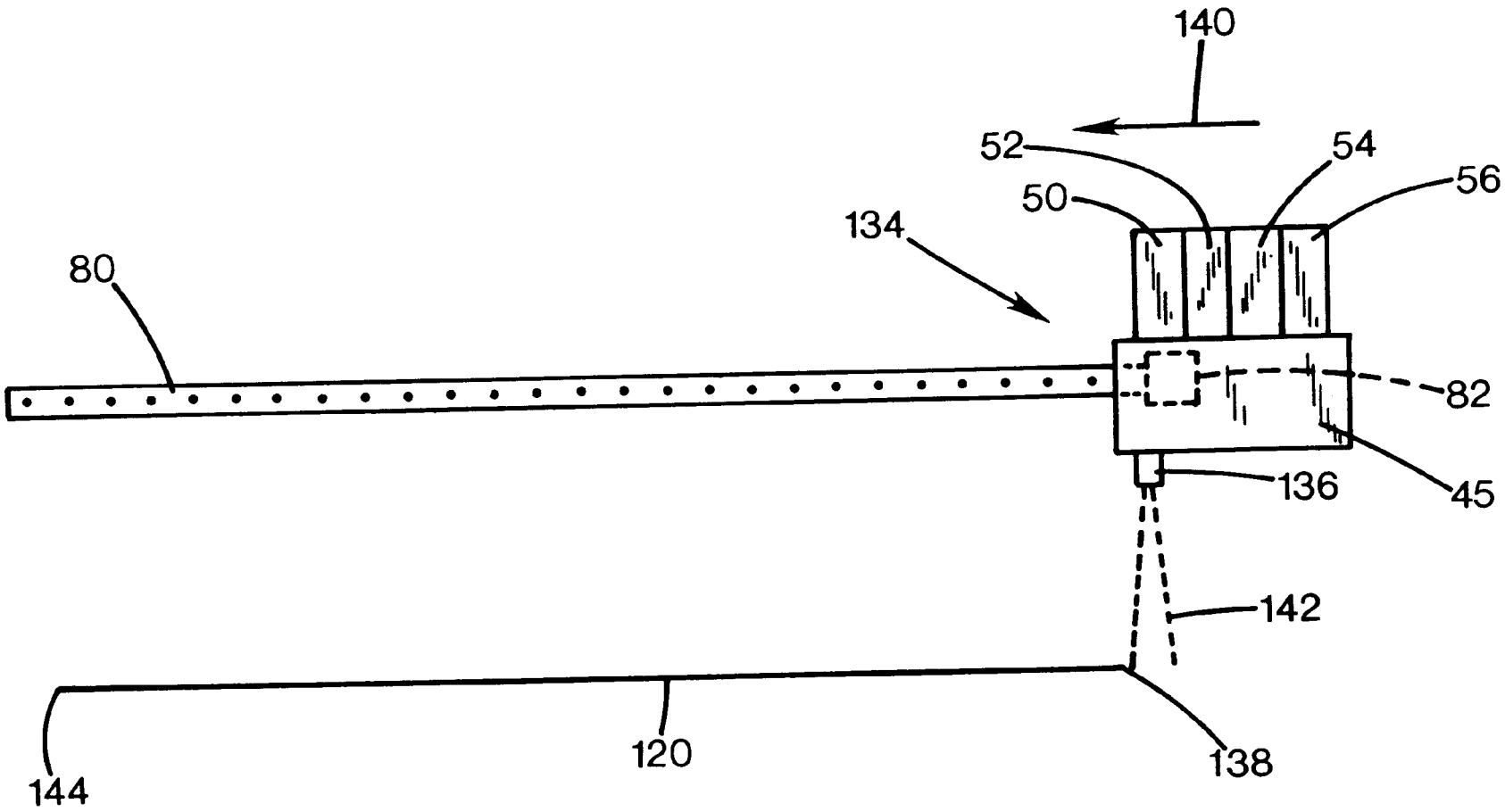
FIG. 4 is a side view of a print medium width sensor in accordance with the present invention configured to measure a width of a print medium.

A side view of a print medium width sensor 134 constructed in accordance with the present invention is shown in FIG. 4. Print medium width sensor 134 is configured to measure a width of different sizes of print medium transported by print medium handling system 26 from input tray 28 to printzone 25, such as the width of print medium 120. As can be seen in FIG. 4, print medium width sensor 134 includes optical quadrature encoder strip 80, carriage position quadrature encoder reader 82, and a print medium side detector 136.

In operation, print medium 120 is transported from input tray 28 to printzone 25 by print media handling system 26 in a direction generally indicated by arrow 122, as discussed above in connection with FIG. 3. Prior to entering printzone 25, carriage 45 is moved in the direction of arrow 140 so that side 138 of print medium 120 is detected by beam 142 of print medium side detector 136. Detection of side 138 of print medium 120 signals computing device 40 to begin measuring the distance traveled by carriage 45 in the direction of arrow 140 by recording the position shown on optical quadrature encoder strip 80. Carriage 45 continues movement in the direction of arrow 140 until side 144 of print medium 120 is detected by print medium side detector 136 of print medium width sensor 134 at which point computing device 40 ceases to measure the distance traveled by carriage 45. Computing device 40 can then calculate the width of print medium 120 which is equal to the distance traveled by carriage 45 as measured by optical quadrature encoder strip 80 and carriage position quadrature encoder reader 82.

As discussed above, ideally print medium width adjuster 39 should be positioned against one of the sides of a print medium in input tray 28 to help assure proper registration of the print medium against wall 116 of input tray 28. Such registration in turn helps assure proper transport by print media handling system 26 from input tray 28 to printzone 25. If either print medium length adjuster 38 or print medium width adjuster 39 is not positioned against one of the sides of the print medium, then the print medium may not be properly registered. Such improper registration can cause the print medium to be incorrectly fed into the print zone of a printing device such that the printed image is improperly oriented on the print medium, producing less than optimal output print quality. In some cases, the printed output may be partially or completely illegible. Improper positioning of either print medium length adjuster 38 or print medium width adjuster 39 may also lead to jamming of printing device 20 during transport of the print medium to print zone 25 which requires user intervention and decreases printing device 20 throughput, both of which are undesirable. Improper positioning of either print medium length adjuster 38 or print medium width adjuster 39 may further lead to wasted print medium caused by such poor printing device 20 output print quality and jamming which can be expensive. The present invention is directed to solving printing device 20 problems caused by improper positioning of either the print medium length adjuster 38 or print medium width adjuster 39.

Figure 5:
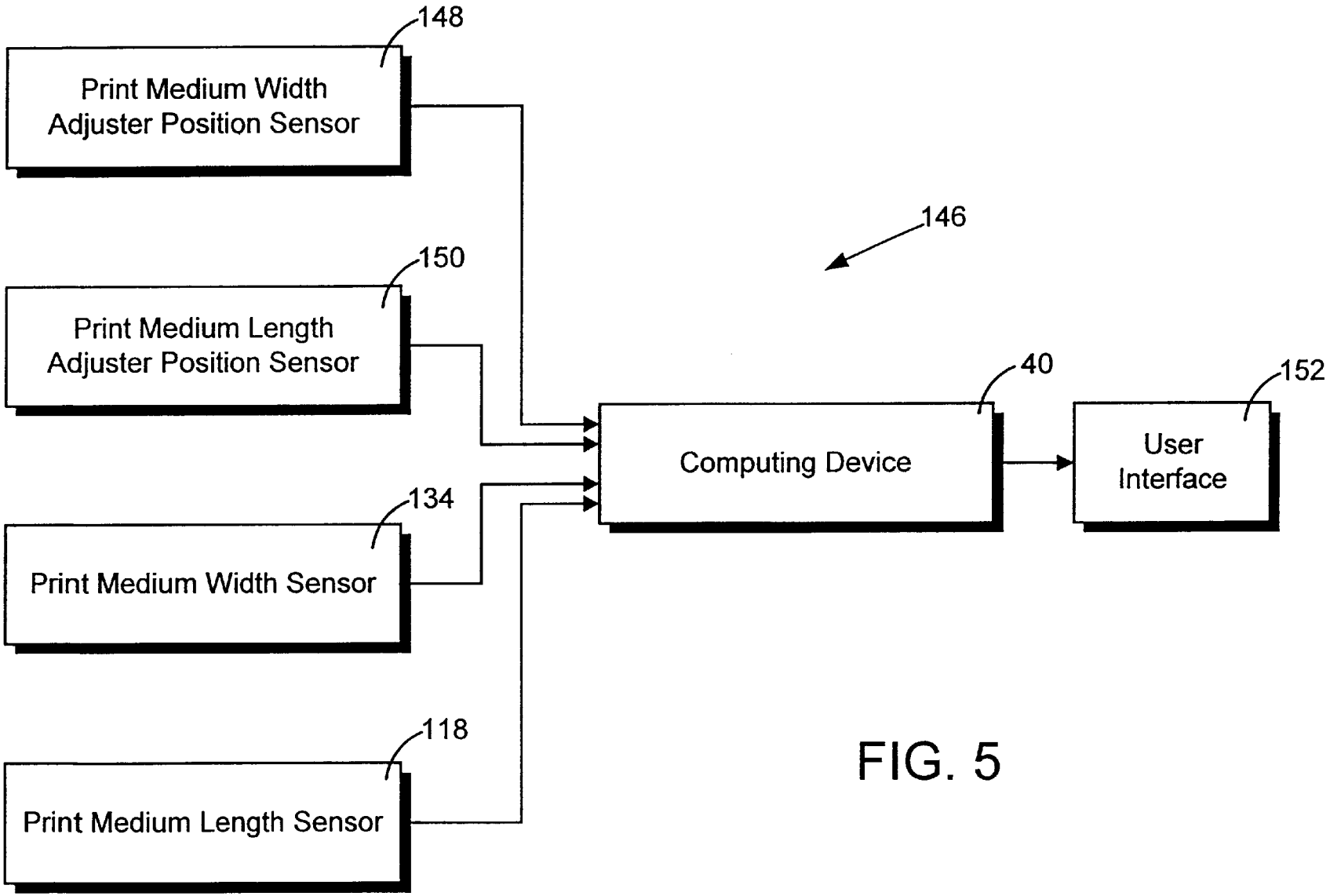
FIG. 5 is a schematic block diagram of an embodiment of an apparatus in accordance with the present invention.

A schematic block diagram of an embodiment of an apparatus for detecting error in loading print medium in a printing device 146 in accordance with the present invention is shown in FIG. 5. As can be seen in FIG. 5, apparatus 146 includes a print medium width adjuster position sensor 148 that is electrically coupled to computing device 40. Print medium width adjuster position sensor 148 determines the position of print medium width adjuster 39 in input tray 28.

Print medium width adjuster position sensor 148 may be configured in a variety of different ways including both electrically or optically. For example, an electrical configuration could include the use of a potentiometer consisting of electrical contacts on the bottom of at least one of bases 104 or 106 and a corresponding electrical contact along the length of either or both of respective tracks 108 and 110. Depending on the particular configuration, one end of either or both of tracks 108 and 110 could be connected to a voltage and the other end connected to ground. For the particular location of print medium width adjuster 39, the value of the resistance at either or both of bases 104 and 106 could then be measured and interpreted by computing device 40 to determine the position of print medium width adjuster 39. An optical configuration could include the use of emitter/detector pairs on base 104 and track 108, and additionally or alternatively on base 106 and track 110.

As can also be seen in FIG. 5, apparatus 146 additionally includes a print medium length adjuster position sensor 150 that is electrically coupled to computing device 40. Print medium length adjuster position sensor 150 determines the position of print medium length adjuster 38 in input tray 28.

Print medium length adjuster position sensor 150 may be configured in a variety of different ways including both electrically or optically. For example, an electrical configuration could include the use of a potentiometer consisting of electrical contacts on the bottom of base 96 and a corresponding electrical contact along the length of track 98. One end of track 98 could be connected to a voltage and the other end connected to ground. For the particular location of print medium length adjuster 38, the value of the resistance at base 96 could then be measured and interpreted by computing device 40 to determine the position of print medium length adjuster 38. An optical configuration could include the use of an emitter/detector pair on base 96 and track 98.

As can additionally be seen in FIG. 5, apparatus 146 includes print medium width sensor 134 that is electrically coupled to computing device 40 and was discussed above in connection with FIG. 4. As can further be seen in FIG. 5, apparatus 146 also includes a print medium length sensor 118 that is electrically coupled to computing device 40 and was discussed above in connection with FIG. 3. In accordance with the present invention, computing device 40 is configured to utilize the data provided by sensors 118, 134, 148, and 150 to detect error in loading print medium in printing device 20, as discussed more fully below in connection with FIG. 6, and output any detected error through a user interface 152, such a display (not shown) of printing device 20 or monitor coupled to a computer host (also not shown).

A flow chart of an embodiment of a method for detecting error in loading print medium in a printing device 154 in accordance with the present invention is shown in FIG. 6. As can be seen in FIG. 6, method 154 includes determination of the print medium width adjuster position 156 by the above-described print medium width adjuster position sensor 148 and determination of the print medium length adjuster position 158 by the above-described print medium length adjuster position sensor 150. Method 154 additionally includes measurement of the print medium width 160 by the above-described print medium width sensor 134 and measurement of the print medium length 162 by the above-described print medium length sensor 118.

Next, the print medium width adjuster position is compared with the measured print medium width 164 and a determination made as to whether the print medium width adjuster position and the print medium width are the same 166. If they are the same, then print medium width adjuster 39 is properly positioned against a side of the print medium helping to properly register the print medium for transport by print media handling system 26, and the print medium length adjuster position is next compared with the measured print medium length 168. If not, then the user of printing device 20 is prompted via user interface 152 to properly position print medium width adjuster 39 as indicated at 176, and the print medium width adjuster position again determined 156, as shown.

Once print medium width adjuster 39 has been properly positioned, the print medium length adjuster position is compared with the measured print medium length 168, and a determination is made as to whether the print medium length adjuster position and the print medium length are the same 171. If they are the same, then print medium length adjuster 38 is properly positioned against a side of the print medium helping to properly register the print medium for transport by print media handling system 26, and method 154 ends 172. If not, then the user of printing device 20 is prompted via user interface 152 to properly position print medium length adjuster 38 as indicated at 174, and the print medium length adjuster position again determined 158, as shown. The method continues until print medium length adjuster 38 is properly positioned against a side of the print medium.

Although the invention has been described and illustrated in detail, it is to be clearly understood that the same is intended by way of illustration and example only, and is not to be taken necessarily, unless otherwise stated, as an express limitation. For example, alternative embodiments of apparatuses and methods in accordance with the present invention may only determine proper position of either print medium length adjuster 38 or print medium width adjuster 39, rather than both as discussed above. The spirit and scope of the present invention are to be limited only by the terms of the following claims.

What is claimed is:

1. A method for use in a printing device, the method comprising:

determining a position of a print medium width adjuster with the printing device;

measuring a width of a print medium with the printing device;

comparing the print medium width adjuster position with the determined print medium width; and prompting a user of the printing device to properly position the print medium width adjuster in instances where the print medium width adjuster is improperly positioned for the determined print medium width.

2. The method of claim 1, further comprising:

determining a position of a print medium length adjuster;

measuring a length of the print medium;

comparing the print medium length adjuster position with the determined print medium length; and prompting a user of the printing device to properly position the print medium length adjuster in instances where the print medium length adjuster is improperly positioned for the determined print medium length.

3. A method for use in a printing device, the method comprising:

determining a position of a print medium length adjuster with the printing device;

measuring a length of a print medium with the printing device;

comparing the print medium length adjuster position with the determined print medium length; and prompting a user of the printing device to properly position the print medium length adjuster in instances where the print medium length adjuster is improperly positioned for the determined print medium length.

4. An apparatus for use in a printing device, the apparatus comprising:

means for determining a position of a print medium width adjuster;

means for measuring a width of a print medium;

means for comparing the print medium width adjuster position with the determined print medium width; and means for prompting a user of the printing device to properly position the print medium width adjuster when the print medium width adjuster position differs from the determined print medium width.

5. The apparatus of claim 4, further comprising:

means for determining a position of a print medium length adjuster;

means for measuring a length of the print medium;

means for comparing the print medium length adjuster position with the determined print medium length; and means for prompting a user of the printing device to properly position the print medium length adjuster when the print medium length adjuster position differs from the determined print medium length.

6. An apparatus for use in a printing device, the apparatus comprising:

means for determining a position of a print medium length adjuster;

means for measuring a length of a print medium;

means for comparing the print medium length adjuster position with the determined print medium length; and means for prompting a user of the printing device to properly position the print medium length adjuster when the print medium length adjuster position differs from the determined print medium length.

7. An apparatus for use in a printing device, the apparatus comprising:

a print medium width adjuster position sensor configured to determine a position of a print medium width adjuster;

a width sensor configured to measure a width of a print medium; and a computing device configured to compare the print medium width adjuster position determined by the print medium width adjuster position sensor with the print medium width measured by the width sensor, and the computing device further configured to verify that the print medium width adjuster is properly positioned for the determined print medium width.

8. The apparatus of claim 7, further comprising:

a print medium length adjuster position sensor configured to determine a position of a print medium length adjuster; and a length sensor configured to measure a length of the print medium;

wherein the computing device is additionally configured to compare the print medium length adjuster position determined by the print medium length adjuster position sensor with the print medium length measured by the length sensor, and the computing device is further configured to verify that the print medium length adjuster is properly positioned for the determined print medium length.

9. The apparatus of claim 8, wherein the length sensor includes a print medium axis position quadrature encoder.

10. The apparatus of claim 8, wherein the length sensor includes a flag configured to be actuated by the print medium.

11. The apparatus of claim 7, wherein the width sensor includes a printing device carriage position quadrature encoder.

12. An apparatus for use in a printing device, the apparatus comprising:

a print medium length adjuster position sensor configured to determine a position of a print medium length adjuster; and a length sensor configured to measure a length of a print medium;

a computing device configured to compare the print medium length adjuster position determined by the print medium length adjuster position sensor with the print medium length measured by the length sensor, and the computing device further configured to verify that the print medium length adjuster is properly positioned for the determined print medium length.

13. The apparatus of claim 12, wherein the length sensor includes a print medium axis position quadrature encoder.

14. The apparatus of claim 12, wherein the length sensor includes a flag configured to be actuated by the print medium.

* * * * *